US008944559B2

(12) United States Patent
Buckland

(10) Patent No.: US 8,944,559 B2
(45) Date of Patent: Feb. 3, 2015

(54) PRINTHEAD

(75) Inventor: Justin Rorke Buckland, Cambridgeshire (GB)

(73) Assignee: The Technology Partnership, Plc., Hertfordshire (GB)

( * ) Notice: Subject to any disclaimer, the term of this patent is extended or adjusted under 35 U.S.C. 154(b) by 172 days.

(21) Appl. No.: 13/517,138

(22) PCT Filed: Dec. 17, 2010

(86) PCT No.: PCT/GB2010/052129
§ 371 (c)(1), (2), (4) Date: Jul. 19, 2012

(87) PCT Pub. No.: WO2011/077120
PCT Pub. Date: Jun. 30, 2011

(65) Prior Publication Data

US 2012/0274686 A1 Nov. 1, 2012

(30) Foreign Application Priority Data

Dec. 22, 2009 (GB) ..... 0922371.0

(51) Int. Cl.
*B41J 2/145* (2006.01)
*B41J 2/14* (2006.01)

(52) U.S. Cl.
CPC ..... *B41J 2/14201* (2013.01); *B41J 2202/15* (2013.01)
USPC ..... 347/20; 347/48

(58) Field of Classification Search
USPC ..... 347/20, 40, 47, 48, 54–56, 63, 73, 74
See application file for complete search history.

(56) References Cited

U.S. PATENT DOCUMENTS

| | | | | |
|---|---|---|---|---|
| 5,578,680 | A * | 11/1996 | Ando et al. | 525/131 |
| 7,416,268 | B2 * | 8/2008 | Oku | 347/11 |
| 2001/0035700 | A1 | 11/2001 | Percin et al. | |
| 2003/0142170 | A1 | 7/2003 | Haluzak et al. | |
| 2009/0101064 | A1 * | 4/2009 | Naka et al. | 118/313 |

FOREIGN PATENT DOCUMENTS

| | | |
|---|---|---|
| EP | 0416540 | 3/1991 |
| JP | 2001096744 | 4/2001 |
| WO | 2007016237 | 2/2007 |

* cited by examiner

*Primary Examiner* — Julian Huffman
*Assistant Examiner* — Sharon A Polk
(74) *Attorney, Agent, or Firm* — Tarolli, Sundheim, Covell & Tummino LLP

(57) ABSTRACT

A print head comprising a nozzle plate having a plurality of nozzles extending therethrough, a piezoelectric bending mode actuator associated with each nozzle and connected with the respective nozzle so as to provide a plurality of independently actuatable nozzles, and a mount for, in use, connecting the nozzle plate to a liquid printer, wherein, in use, each nozzle can be driven at its resonant frequency such that motion of the driven nozzle causes liquid to be ejected only from the driven nozzle.

26 Claims, 3 Drawing Sheets

PRINTHEAD

BACKGROUND

The present invention is directed to a print head and, in particular, to one that is designed to meet the requirements for microarray printing.

Microarrays have requirements that differ from most image printing applications, and therefore conventional print head designs are not optimal for this application. Microarrays contain a matrix of sites onto which liquid reagents are deposited. A sample applied to the microarray reacts at different sites containing different reagents. The results of the reactions are usually interrogated optically, providing a highly multiplexed analysis of the sample. Requirements of typical microarrays are:

- Many different reagents to be deposited (typically 20-10000)
- Few replicates (sites containing a common reagent) (typically 2-10)
- Replicates should be distributed across the area of the array (in widely separated rows and columns, typically at least 1 mm separation)
- Total number of spots is typically 100-1,000,000
- Spot spacing is typically 30-1000 microns
- Array size is typically 3 mm×3 mm to 75 mm×75 mm
- Spots must be satellite-free and clearly separated from neighbours to enable automated analysis of the microarray
- Reagents can include DNA, proteins, antibodies, cells and cell fragments and other materials including suspensions
- Reagents may have stringent material compatibility requirements
- Thorough and automated cleaning and reservoir refill is required.

For high speed and reliability, non-contact ink-jet printing is beneficial for microarray manufacture. Contact pin methods are relatively slow and have high pin maintenance requirements. Additionally, fixed print heads are preferred to avoid mechanical complexity associated with a scanning head.

Conventional industrial ink-jet heads (e.g. Dimatix, Xaar) can be used to manufacture microarrays. These typically have large numbers of nozzles (128 or more) on a narrow pitch (254 microns) sharing a common reservoir. The number of print heads required is equal to the number of reagents, increasing the size and cost of manufacturing equipment and requirements for print head registration. Replicates are usually widely spaced so the narrow nozzle pitch is not required and adds complexity.

Single nozzle print heads (e.g. piezo tube type) are an alternative method for fabrication of microarrays. These can be arranged at the required separation to match replicate locations but require registration of (no. of replicates×no. of reagents). This would be very challenging.

Both methods above suffer from poor cleanability and low tolerance to air bubbles, due to the presence of narrow channels and the compression-chamber ejection mechanism.

EP0615470 describes a circularly-actuated piezoelectric-driven nozzle, which has more robust construction and is more capable of ejecting viscous liquids than linear bending mode devices such as those described in EP1071559. However a multiple nozzle print head based on the circularly-actuated device described in EP0615470 would suffer from high levels of crosstalk. The mounting structure in the invention described below circumvents this problem.

SUMMARY OF THE INVENTION

The present invention overcomes the above problems and provides a print head more suitable for microarray manufacture.

According to the present invention, there is provided a print head comprising:

a nozzle plate having a plurality of nozzles extending therethrough;

a piezoelectric bending mode actuator associated with each nozzle and connected with the respective nozzle so as to provide a plurality of independently actuatable nozzles; and a mount for, in use, connecting the nozzle plate to a liquid printer, wherein, in use, each nozzle can be driven at its resonant frequency such that motion of the driven nozzle causes liquid to be ejected only from the driven nozzle.

It is preferable that the mass of the mount is greater than the combined mass of the nozzle plate and piezoelectric actuators.

It is preferable that the mount is also stiffer in bending than the combination of the nozzle plate and piezoelectric actuators that it supports.

The piezoelectric actuators are preferably located on the outside of the nozzle plate, i.e. the side not in contact with liquid to be ejected, to eliminate contact between the piezoelectric actuator materials and liquid to be ejected as such contact may damage the actuator, particularly in the case of aqueous and electrically conductive liquids, and may also contaminate the liquid to be ejected.

The piezoelectric actuators may be formed as a single structure, e.g. by creating appropriately aligned holes (to correspond to the nozzles) in a single sheet of piezoelectric material. Alternatively, the piezoelectric actuators may be discrete elements. The piezoelectric actuators are preferably annular regions, each surrounding a nozzle.

The head may further comprise one or more reservoirs for supplying liquid to be deposited by the nozzles. Separate reservoirs may be provided for each nozzle or a single reservoir may supply liquid to all of the nozzles.

Each reservoir may be exchangeable for a different reservoir—for example the reservoir may have a snap-fit fastening such that a user can easily replace a reservoir when it is empty. Alternatively, the reservoir(s) may be re-usable, i.e. they can be refilled with liquid, such that repeated deposition can be carried out. In either case, the reservoir(s) are preferably provided with a rubber septum seal to enable the reservoir(s) to be filled with the liquid to be deposited.

The reservoir may alternatively be formed by a lid connected to the head and defining therebetween a fluid chamber in which liquid can be stored.

Each reservoir preferably has a smooth inner profile and at least one inlet and one outlet to permit effective cleaning by flushing through with a cleaning fluid. The outlet may be the same as the outlet to the nozzles, but preferable the outlet is a separate port. The inlet may be the same as that through which liquid to be deposited is supplied, but it may be a separate port.

The nozzle plate is preferably formed of a sheet material and may be a laminate structure or alternatively may be formed from a single layered material. The term "plate" covers both a flexible plate and also a flexible membrane.

If the nozzle plate comprises a plurality of layers, one or more of those layers may be a support layer such that other layer(s) provide the nozzles. By this, we mean that the holes in the support layer do not define the openings which are the nozzles i.e. do not affect flow through the nozzle plate, but rather are simply provided to give support to the layer(s) which contain the nozzles.

The nozzle plate may be connected directly to the piezoelectric actuators, but in the case of a laminate nozzle plate, an intermediate layer or layers may be between the nozzle plate and the piezoelectric actuators.

The nozzle plate is preferably continuous, i.e. is a single structure in which multiple nozzles are formed.

The piezoelectric actuators are preferably covered by an insulating material, such as a polyimide material. Preferably, the covering material is either or both of electrically and chemically inert to aqueous solutions and organic solvents. The insulating material helps to prevent damage to the piezoelectric material or adjacent glue bond by contact with liquids.

The mount is preferably a composite mount and is formed from at least two materials. In this situation, the first material, typically a metal such as steel, provides the required stiffness (Young's modulus of the stiff material should be comparable with or greater than that of the piezoelectric material, typically a minimum of 50 GPa), and the second material, typically an elastomeric material such as rubber, provides the required damping (the loss modulus should be at least 5% of the storage modulus and preferably at least 20% of the storage modulus at the temperature and frequency of operation).

It is preferable that the thickness ratio of the piezoelectric actuators to the layer adjacent the piezoelectric actuators (it may be the nozzle plate or may be some intermediate structure) satisfies $E_{pzt}.h_{pzt}^2 \approx E_{adj}.h_{adj}^2$, where E is the Young's modulus of the respective layer and h is the thickness of the respective layer. Preferably $0.5<(E_{pzt}.h_{pzt}^2)/(E_{adj}.h_{adj}^2)<2$.

The piezoelectric bending actuator may be a unimorph actuator comprising a piezoelectric layer bonded to a substrate layer, where the thickness ratio of the piezoelectric layer and substrate layer are chosen to satisfy the relation: $E_{PZT}.h_{PZT} \sim E_{SUB}.h_{SUB}$, where $E_{PZT}$ and $E_{SUB}$ are the Young's moduli of the piezoelectric and substrate layers respectively, and $h_{PZT}$ and $h_{SUB}$ are the thicknesses of the piezoelectric and substrate layers respectively. The substrate layer may be the nozzle plate. The substrate layer is preferably between 1 and 10 times thicker than the nozzle plate and is in contact with the nozzle plate.

Addressable electrical contacts may be provided on each nozzle, each contact being connected to a region of the associated piezoelectric actuator. The connection is preferably by way of conductive tracks on the insulating layer.

Kinematic mounting features may be provided on the head to allow accurate alignment of the deposition head with the deposition device. The kinematic mount features are preferably on the nozzle plate.

The head is preferably controlled by a control means, such as a processor or an ASIC. The control may be such that only one nozzle can be driven at any particular time or alternatively a plurality of nozzles can be driven simultaneously. Each nozzle may be driven either continuously or in short bursts.

The control of the actuation of the nozzles is preferably also defined so as to minimise crosstalk between the driven nozzle(s) and the non-driven nozzle(s), so that actuation of one or more driven nozzles does not cause ejection from a non-driven nozzle.

In the present invention, a number of nozzles are formed in a continuous nozzle plate to allow independently actuated ejection from each nozzle. Use of a continuous nozzle plate increases the robustness of the nozzle plate and can allow it to be wiped clean if required. By continuous, we mean a single structure in which multiple or even all the nozzles are formed. The continuous nozzle plate, as described above, may be a single layer or may be a laminate structure.

The nozzle plate is actuated in a bending mode to provide motion perpendicular to its plane, typically by a set of annular or circular piezoelectric actuators (one surrounding each nozzle). For ease of manufacture, the piezoelectric actuators may be formed from a single piece of piezoelectric material with patterned and addressable electrodes. Electrical connection to the piezoelectric and encapsulation of the piezoelectric may be provided by a polyimide flexible circuit.

The piezoelectric material and electrical contacts may be external to the reservoir to avoid contact with the liquid being printed. This is advantageous when printing electrically conductive liquids.

The nozzle plate may comprise a single sheet of electroformed nickel, laser-drilled steel, electrical-discharge machined steel, or laser-drilled polyimide, or etched silicon, or other sheet material.

Motion of the nozzle plate drives droplet ejection from nozzles as described in EP0615470. In order to minimise the inevitable cross-talk between closely spaced nozzles formed in a continuous sheet, the nozzle plate is preferably supported by a dense, stiff, highly-damped anti-crosstalk mounting structure.

This may consist of a steel frame mounted on a rubber part. The mounting structure should preferably be stiff and massive relative to the actuator and nozzle plate combined so that deflection of the mounting structure is minimised when a nozzle is driven. The mounting structure should preferably have at least 10 times the bending stiffness and at least 5 times the mass of the actuator or nozzle plate, and preferably at least 100 times the bending stiffness and at least 25 times the mass of the actuator and nozzle plate combined.

It is beneficial to be able to drive a nozzle in drop-on-demand mode, or continuously at its resonant frequency, or in a burst of finite duration. This allows ejection of a single droplet, or a continuous stream of droplets, or a burst of a finite number of droplets. If the mounting structure is not sufficiently highly damped, a burst or continuous drive will generate oscillations in the mounting structure at the drive frequency, which will in turn excite other nozzles in the print head, causing cross-talk. Therefore, when excited at the frequency of the actuator drive waveform, the mounting structure should preferably oscillate with at least 1% of critical damping, and preferably at least 5% of critical damping, and more preferably at feast 20% of critical damping.

A common reservoir may be formed by the nozzle plate, mounting structure and lid. This reservoir may be designed without walls or barriers between adjacent nozzles, and with a smooth profile to allow easy cleaning by flushing through with a cleaning liquid. This structure may also allow easy filling of an empty reservoir without formation or trapping of bubbles which could impair the performance of the print head.

The nozzle plate may include kinematic mounting features to allow precise alignment. By incorporating these features into the nozzle plate, accurate registration of nozzle locations can be achieved. In microarray production, many print heads may be needed (one per reagent) and the kinematic mounting features eliminate the need for time-consuming alignment of individual print heads.

DESCRIPTION OF FIGURES

In FIG. 1, the mounting structure comprises a steel mount in contact with a rubber mount where the steel mount is in contact with the nozzle plate. Alternatively, the mounting structure may be constructed from other combinations of a stiff material in contact with the nozzle plate and a highly damping material in contact with the stiff material.

Figure 1:
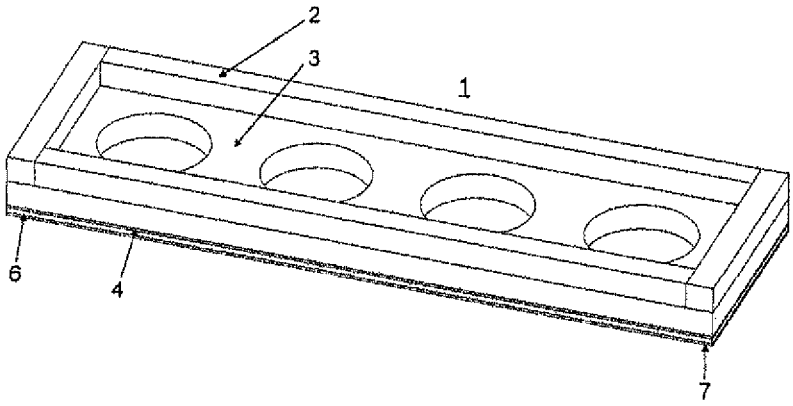
FIG. 1 shows a print head (1) comprising a mount (2) including a soft material with strong damping properties; a layer of stiff material (3); a thin plate or membrane (4) perforated with nozzles (not shown); a layer of piezoelectric material (6); and a protective layer (7) which can also include one or more electrical contacts (not shown).
Figure 2:
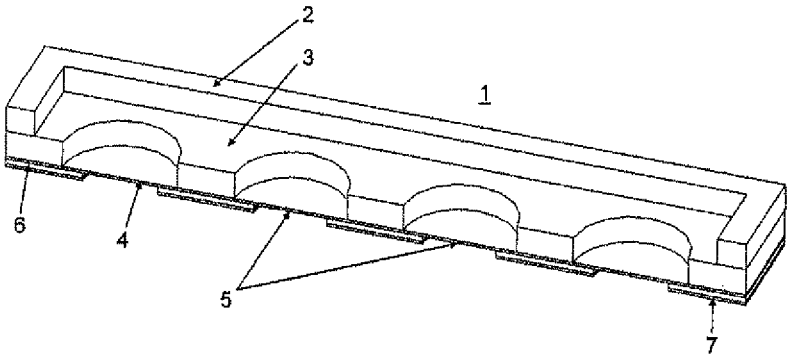
FIG. 2 shows a cut-away view of a print head (1) comprising: a soft material (2) with strong damping properties; a layer of stiff material (3); a thin plate or membrane (4) perforated with nozzles (5); a layer of piezoelectric material (6); and a protective layer (7) which can also include one or more electrical contacts (not shown).
Figure 3:
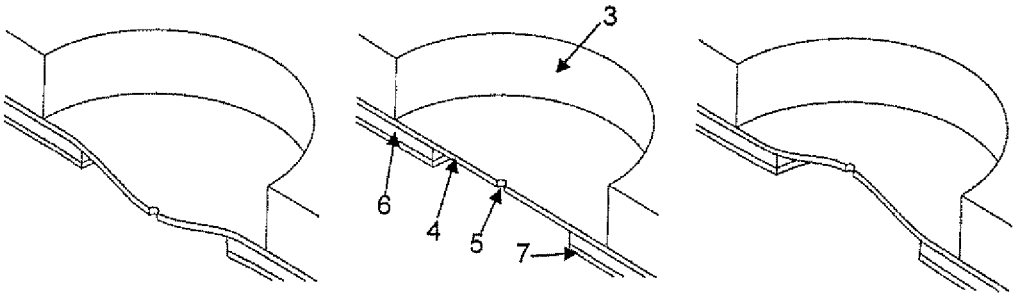
FIG. 3 shows a finite element simulation of a driven nozzle. The three images show different points in the oscillation with a 90° phase shift between consecutive images relative to the phase of a sinusoidal drive signal. The visible components are a layer of stiff material (3); a thin plate or membrane (4) perforated with nozzles (5); a layer of piezoelectric material (6); and a protective layer and electrical contact (7).
Figure 4:
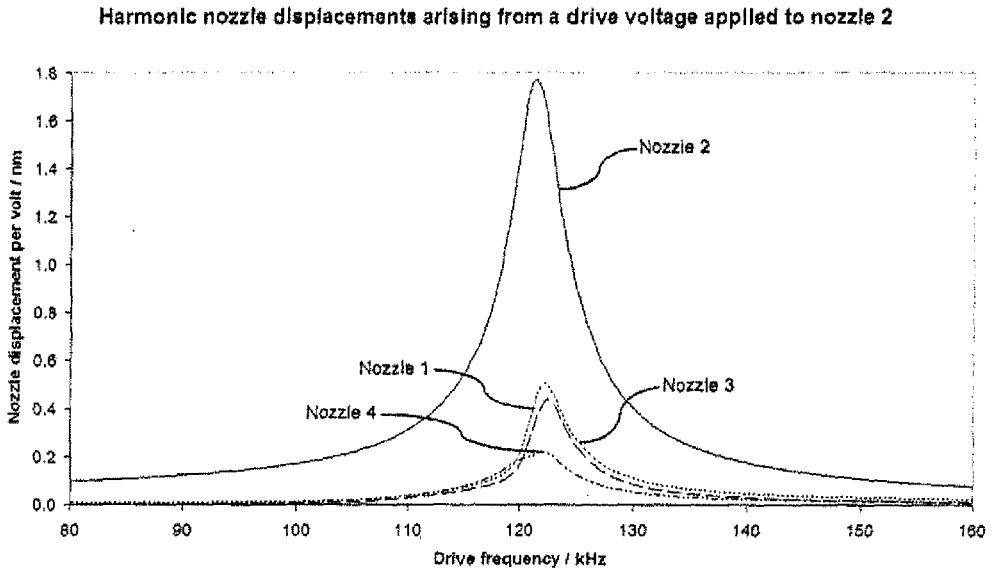
FIG. 4 shows simulation of displacement at a driven nozzle ("Nozzle 2") and at other nozzles ("Nozzle 1", "Nozzle 3" and "Nozzle 4". A continuous sinusoidal drive is applied, and the low amplitude of motion in non-driven nozzles illustrates the low level of crosstalk. Crosstalk in a typical drop-on-demand operation would be at an even lower level than this. Without the damping mount, crosstalk levels are much higher.
Figure 5:
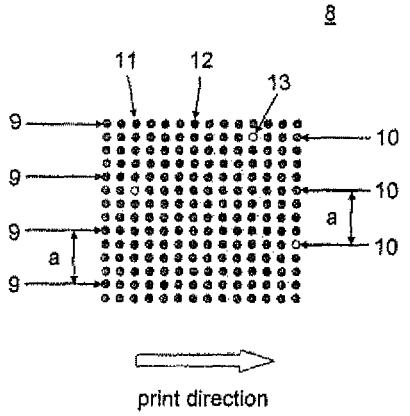
FIG. 5 shows positions of reagent spots in a typical microarray (8), in this case an array consisting of 14×14 spots. An example spot location (11) contains one of a number of reagents. For example, a reagent 1 spot location (12) and a reagent 2 spot location (13) are identified in the figure. In this case, reagent 1 has four replicates, shown as striped circles in rows 1, 5, 9 and 13 (9) and reagent 2 has three replicates, shown as unfilled circles in rows 3, 7, and 11 (10). Solid spots represent other reagents. The replicate spacing in the direction perpendicular to the print direction, a, is equal to the nozzle spacing in this direction. Typically the replicate spacing a is at least 3 times larger than the spot pitch on the microarray.
Figure 6:
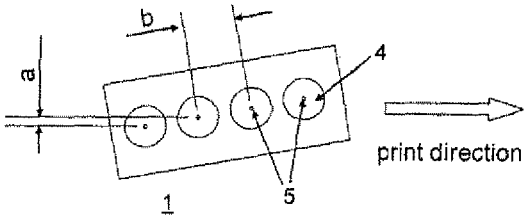
FIG. 6 shows a print head (1) with the nozzle plate (4) angle raked at an angle relative to print direction to achieve the required replicate spacing of a with a larger spacing between nozzles (5) of b. Typical vales of a are 0.1 mm to 3 mm and values of b are 1 mm to 20 mm.
Figure 7:
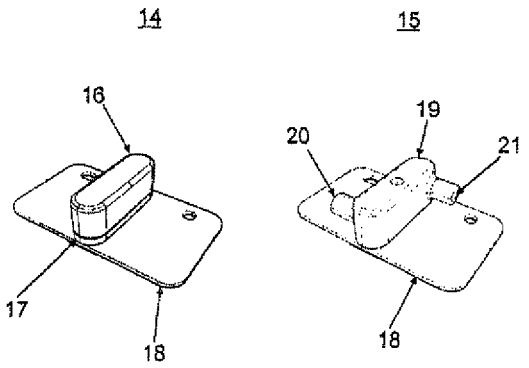
FIG. 7 shows two forms of print head (14, 16) to operate with disposable and fixed reservoirs respectively. The disposable reservoir (16) can be pre-filled with the liquid to be printed, and the fixed reservoir (19) can be filled and cleaned. The fixed reservoir has an liquid inlet port (20) and a liquid outlet port (21) to allow cleaning and flushing of the reservoir contents. Also visible is a reservoir interface (17) and the mounting structure (18).
Figure 8:
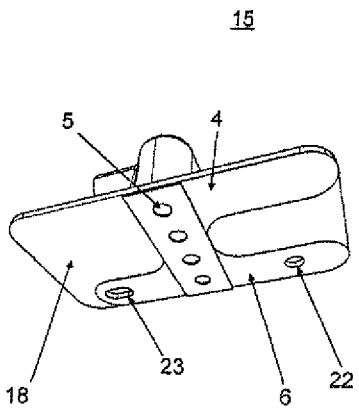
FIG. 8 shows a print head with fixed reservoir (15) viewed from the nozzle plate side. The nozzle plate includes kinematic mounting features including a hole (22) and a slot (23) which in combination with the flat surface of the nozzle plate allow print heads to positioned accurately on the printer. Also visible is are nozzles (5), mounting structure (18) and layer of piezoelectric material (6).
Figure 9:
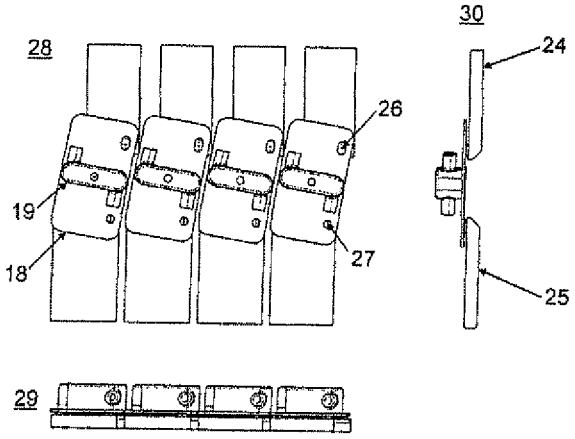
FIG. 9 shows a set of print heads containing four print heads in plan view (28), end view (29) and side view (30). The reservoirs (19) and mounting structures (18) are visible. The print head supports (24, 25) contain pins (26, 27) which locate into holes and slots in the nozzle plate. The print head support also contains a flat (not shown) to complete the kinematic mount.

The invention claimed is:

1. A print head comprising:

a nozzle plate having a plurality of nozzles extending therethrough;

a piezoelectric bending mode actuator associated with each nozzle and connected with the respective nozzle so as to provide a plurality of independently actuatable nozzles; and a mount for, in use, connecting the nozzle plate to a liquid printer, wherein, in use, each nozzle can be driven at its resonant frequency such that motion of the driven nozzle causes liquid to be ejected only from the driven nozzle;

wherein the mount is stiffer than the combination of the nozzle plate and piezoelectric actuators.

2. A print head according to claim 1, wherein the mass of the mount is greater than the combined mass of the nozzle plate and piezoelectric actuators.

3. A print head according to claim 2, wherein the mount has at least 10 times the bending stiffness and at least 5 times the mass of the combination of the nozzle plate and piezoelectric actuators and preferably at least 100 times the bending stiffness and at least 25 times the mass of the combination of the nozzle plate and piezoelectric actuators, and whereby, in operation, at the mounting structure oscillates at the frequency of the actuator drive waveform with at least 1% of critical damping, and preferably at least 5% of critical damping, and more preferably at least 20% of critical damping.

4. A print head according to claim 1, wherein the piezoelectric actuators are located on the outside of the nozzle plate.

5. A print head according to claim 1, wherein the piezoelectric actuators are formed in a single continuous sheet of piezoelectric material.

6. A print head according to claim 1, wherein the piezoelectric actuators are annular regions, each surrounding a nozzle.

7. A print head according to claim 1, wherein further comprising one or more reservoirs for supplying liquid to be deposited by the nozzles.

8. A print head according to claim 7, wherein separate reservoirs are provided for each nozzle.

9. A print head according to claim 7, wherein a single reservoir is provided to supply the same liquid to all of the nozzles.

10. A print head according to claim 7, wherein the or each reservoir is be exchangeable for a different reservoir, preferably by way of a snap-fit fastening such that a user can easily replace a reservoir when it is empty.

11. A print head according to claim 7, wherein the reservoir (s) are re-usable such that repeated deposition can be carried out.

12. A print head according to claim 7, wherein the reservoir (s) are provided with a rubber septum seal to enable the reservoir(s) to be filled with the liquid to be deposited.

13. A print head according to claim 7, wherein the reservoir is formed by a lid connected to the head and defining therebetween a fluid chamber in which liquid can be stored.

14. A print head according to claim 7, wherein each reservoir has a smooth inner profile and at least one inlet and one outlet to permit effective cleaning by flushing through with a cleaning fluid.

15. A print head according to claim 1, wherein the nozzle plate is formed of a sheet material and is a laminate structure.

16. A print head according to claim 15, wherein one or more of the laminate layers is a support layer such that other layer(s) provide the nozzles.

17. A print head according to claim 1, wherein the nozzle plate is formed of a sheet material and is formed from a single Layered material, such as electroformed nickel, laser-drilled steel, electrical-discharge machined steel, laser-drilled polyimide, or etched silicon, or other sheet material.

18. A print head according to claim 1, wherein the nozzle plate is continuous, i.e. is a single structure in which multiple nozzles are formed.

19. A print head according to claim 1, wherein the piezoelectric actuators are covered by an insulating material, such as a polyimide material.

20. A print head according to claim 1, wherein the mount is a composite mount formed from at least two materials.

21. A print head according to claim 1, wherein the thickness ratio of the piezoelectric actuators to the layer adjacent the piezoelectric actuators satisfies $E_{pzt}.h_{pzt}^2 \approx E_{adj}.h_{adj}^2$, where E is the Young's modulus of the respective layer and h is the thickness of the respective layer.

22. A print head according to claim 21, wherein the substrate layer is between 1 and 10 times thicker than the nozzle plate and is in contact with the nozzle plate.

23. A print head according to claim 1, wherein kinematic mounting features are provided on the head to allow, in use, accurate alignment of the deposition head with the printer.

24. A print head according claim 23, wherein the kinematic mount features are on the nozzle plate.

25. A print head according to claim 1, further comprising a control means, such as a processor or an ASIC.

26. A printer comprising:

one or more print heads according to claim 1, and a transport to provide relative motion between the print heads and the substrate onto which liquids are to be printed.

* * * * *